United States Patent [19]

Schwindt

[11] Patent Number: 4,624,094

[45] Date of Patent: Nov. 25, 1986

[54] DOOR PANEL WITH A MIRROR SIDE

[76] Inventor: Benjamin W. Schwindt, 40 Axixa Ave., Bayshore, N.Y. 11706

[21] Appl. No.: 653,690

[22] Filed: Sep. 21, 1984

[51] Int. Cl.[4] ..... A47G 1/00; E04C 2/38

[52] U.S. Cl. ..... 52/786; 52/812; 52/813; 52/822; 52/830; 248/488

[58] Field of Search ..... 52/786, 812, 813, 783, 52/822, 823, 826, 829, 830; 248/475.1, 488

[56] References Cited

U.S. PATENT DOCUMENTS

| | | | |
|---|---|---|---|
| 1,210,934 | 1/1917 | Hayes | 248/488 |
| 1,233,497 | 7/1917 | Ohnstrand | 52/826 |
| 1,921,752 | 8/1933 | Hess | 248/488 |
| 2,184,893 | 12/1939 | Lumley | 248/488 |
| 2,227,150 | 12/1940 | Olston | 52/783 |
| 2,347,176 | 4/1944 | Doner | 52/812 |
| 2,978,078 | 4/1961 | Waller et al. | 52/812 |
| 4,147,004 | 4/1979 | Day et al. | 52/813 |

FOREIGN PATENT DOCUMENTS

| | | | |
|---|---|---|---|
| 1462759 | 11/1966 | France | 248/475 R |

*Primary Examiner*—William F. Pate, III
*Assistant Examiner*—Caroline Dennison
*Attorney, Agent, or Firm*—Kane, Dalsimer, Kane, Sullivan and Kurucz

[57] ABSTRACT

A panel door assembly with a mirrored front side is provided with a relatively rigid rear side, a plurality of rails for spacing said front and rear sides and side channels which form an interference fit with the rear side and the rails. Brackets are mounted on said rails to support said mirrored side.

5 Claims, 7 Drawing Figures

DOOR PANEL WITH A MIRROR SIDE

BACKGROUND OF THE INVENTION

1. Field of Invention

This invention pertains to door panels and more particularly to a door panel with at least one mirror side.

2. Description of the Prior Art

Doors with a mirror at least on one side have many uses. They are very popular as closet doors. Recently mirrored surfaces became a favored means of subjectively extending the size of rooms. Hence doors with mirrors, especially without any unsightly obstructions which interfere with the sense of depth generated by a relatively uninterrupted mirror surface are in great demand.

Typically, the above-mentioned types of doors have been made either by affixing a mirror to a completed door panel, or by using steel frames to surround a mirror. These methods are relatively expensive, require a long assembly time and the end product is usually heavy and subject to dimensional distortions over the years.

OBJECTIVES AND SUMMARY OF THE INVENTION

In view of the above, an objective of the present invention is to provide a door and mirror panel assembly which is light yet resists dimensional distortions.

Another objective is to provide an assembly which is easy to manufacture and assemble.

A further objective is to provide an assembly which can be made to any size.

According to the present invention, a door panel assembly comprises a front mirrored side and rear reinforcing side, extending in parallel with said front side, support means disposed therebetween for spacing, and two channels extending in parallel along the edges of said sides for holding the assembly together. The channels have an E-shaped cross-section to form separate interference fits with the rear side and the support means.

DESCRIPTION OF THE PREFERRED EMBODIMENT

Figure 1:
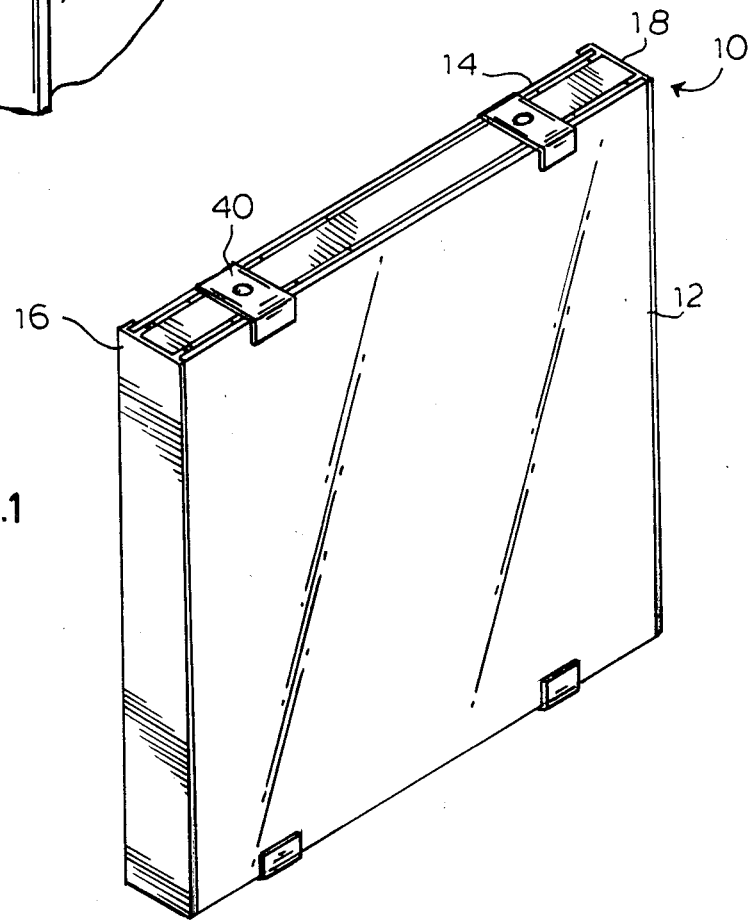
FIG. 1 shows a perspective view of a door panel in accordance with the invention.
Figure 4:
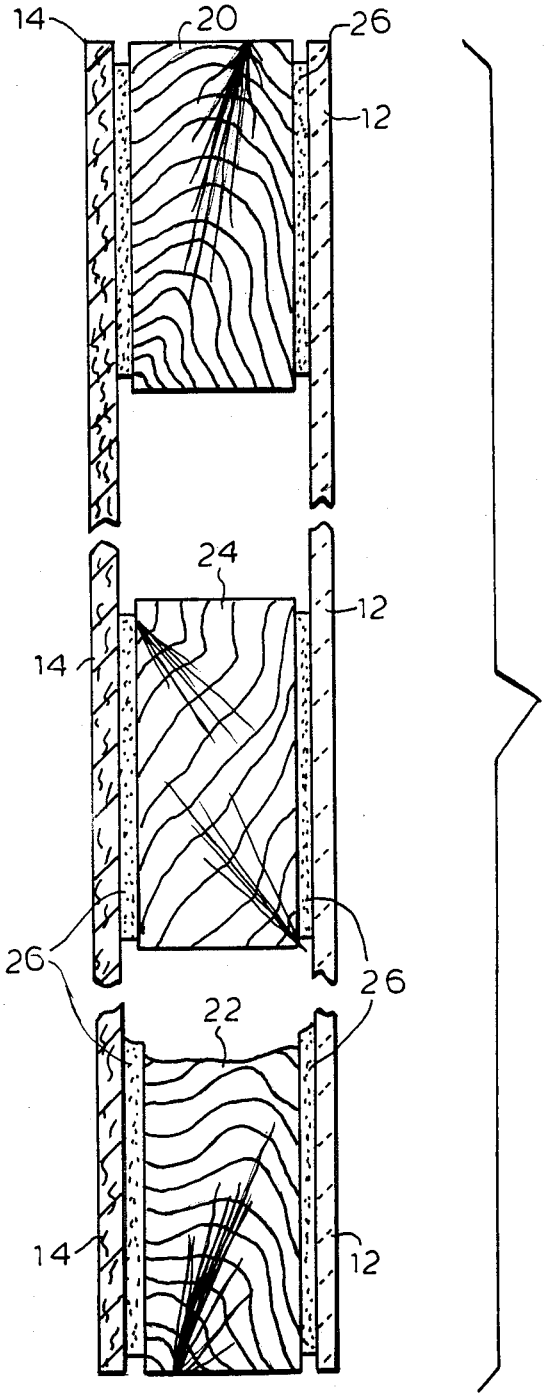

As shown in FIG. 1, a door panel assembly 10 comprises a first side 12 which consists of a substantially uninterrupted mirror surface, a second or rear side 14 and two vertical channels 16 and 18. As can be best seen in FIG. 4, sides 12 and 14 are separated by an upper rail 20 and a lower rail 22 which extend horizontally across the panel. If the panel is relatively long additional rails such as 24 may be used as a stiffening or reinforcing member.

As previously mentioned, side 12 is made of a mirrored glass pane, or a similar mirrored surface such as lucite or a mylar sheet, which is secured by any conventional means to horizontal rails 20 and 22. For example a sponge tape 26 may be used which has adhesive on both sides. Advantageously the tape acts as a filler for the purposes described below.

The second side 14 is made out of a relatively stiff material to give sufficient strength to the panel. For example side 14 may comprise $\frac{1}{4}''$ plywood, pressed board, particulate board, wafer board or other similar materials.

Rails 20 and 22 are preferably made out of wood board such as for example a $\frac{3}{4}'' \times 3\frac{1}{2}''$ solid wood rail. Alternatively a plywood or particulate board may also be used.

Figure 5:
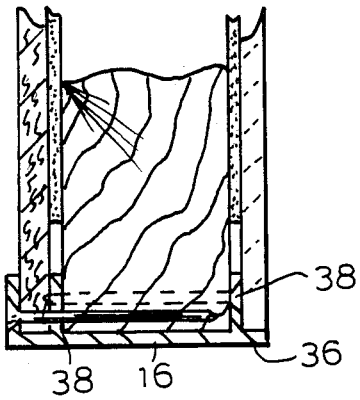
FIGS. 4 and 5 show cross-sectional view of the panel taken along the respective lines shown in FIG. 2.
Figure 7:
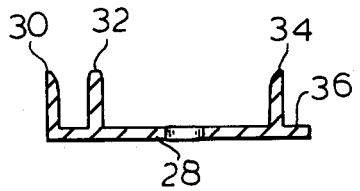
FIG. 7 shows a cross-sectional view of one of the channels.

The channels 16 and 18 preferably have an E-shaped cross-section as shown in FIG. 7. Thus each channel comprises a web 28 and three flanges 30, 32 and 34 extending relatively perpendicularly to and on the same side of web 28. These three flanges have substantially the same width. The distance between flanges 30 and 32 is equal to or slightly smaller than the thickness of side 14. Similarly the distance between flanges 32 and 34 is equal to or slightly less than the thickness of rails 22, 24. Web 28 has a portion 36 which extends passed flange 34 as shown in FIG. 5 by a width which matches the thickness of mirror side 12. The channels are preferably extruded from aluminum or other similar light but relatively strong and stiff material.

Figure 2:
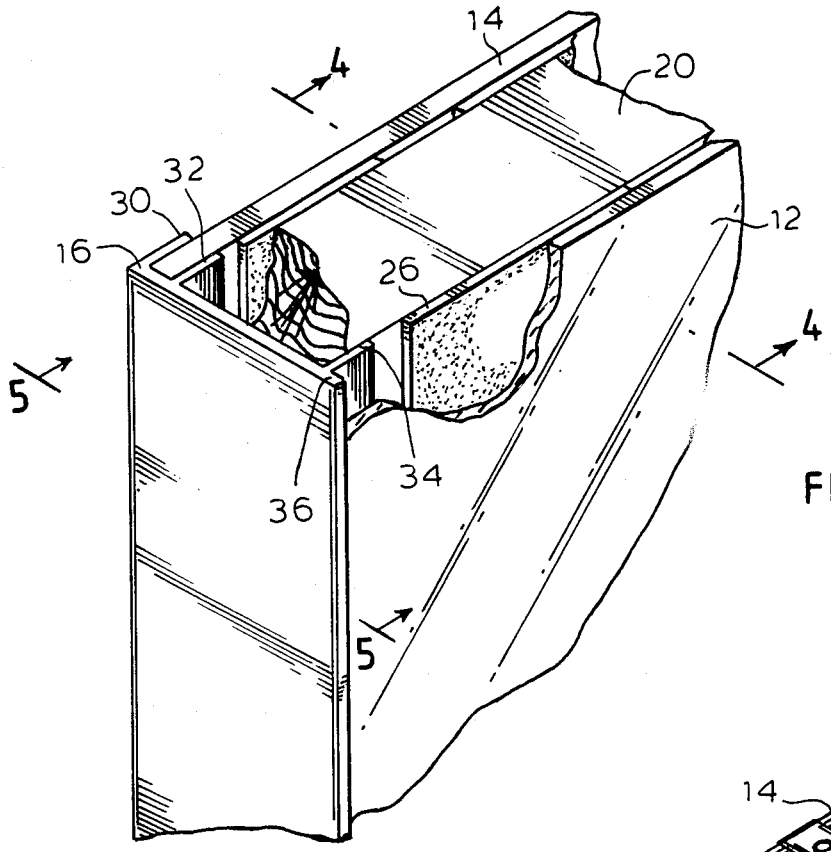
FIG. 2 shows a partial sectional view of the panel.

The door panel is assembled as follows. Sides 12 and 14 are first affixed to rails 20 and 22 by using a sponge tape 26 or fibrous spreader with two adhesive surfaces. Next the two longitudinal channels 16 and 18 are installed to form the assembly shown on FIGS. 1 and 2, by inserting side 14 between flanges 30 and 32 and rails 20 and 22 between flanges 32 and 34. Due to the spacing between these flanges provided by tape 26 an interference or friction fit is formed between the side 14, rails 20, 22 and channels 16, 18. In order to insure that the assembly does not come apart the channels are also secured to rails 20, 22 by nails or screws 38 installed transversally through webs 30 and 32 and through rails 20, 22 as shown in FIG. 5. The thickness of sponge tape 26 is selected to insure that there is proper spacing between the rails and sides 12 and 14 so that the flanges of the channels may be inserted therebetween.

Figure 3:
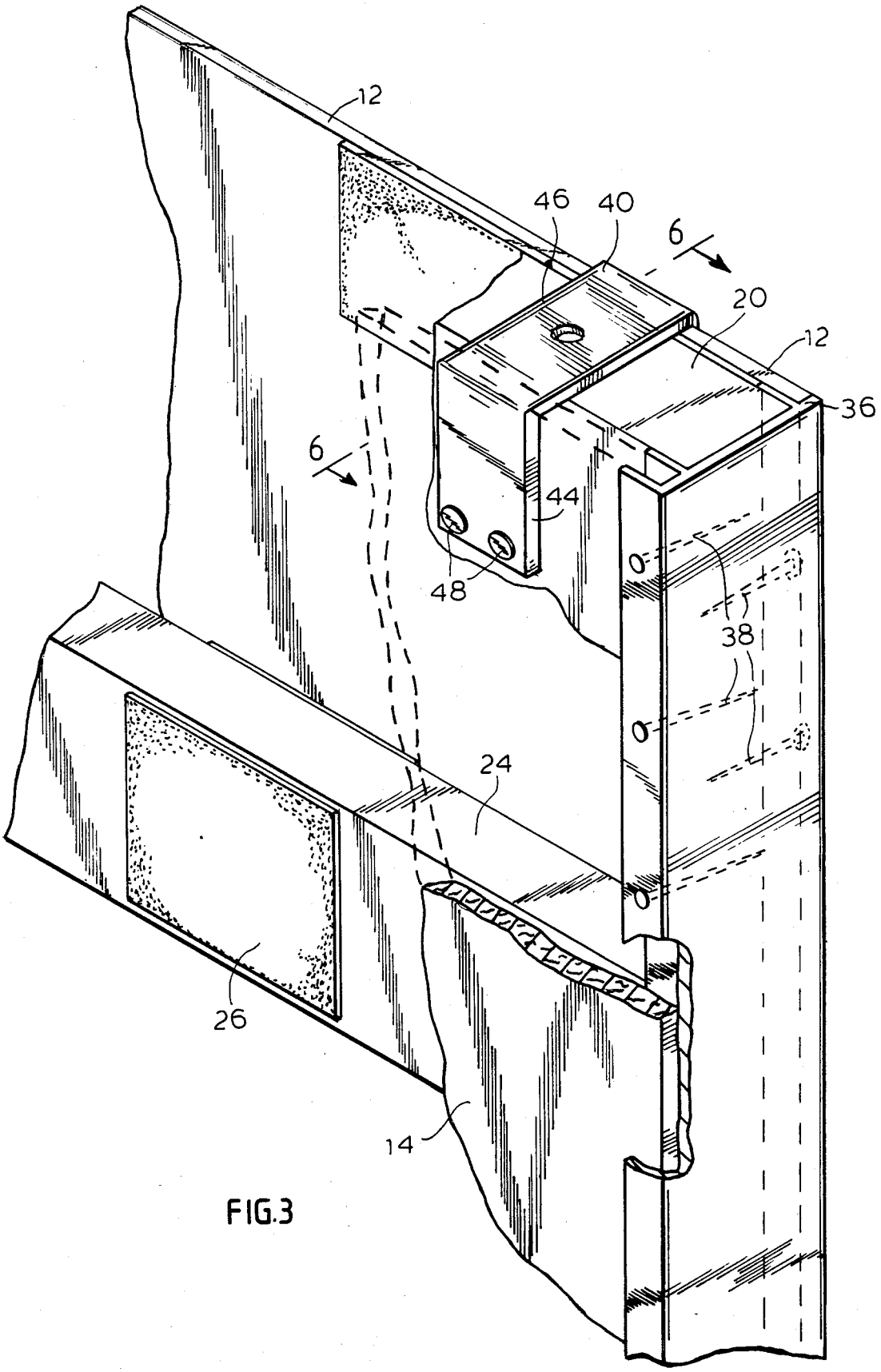
FIG. 3 shows another partial sectional view of the door panel.
Figure 6:
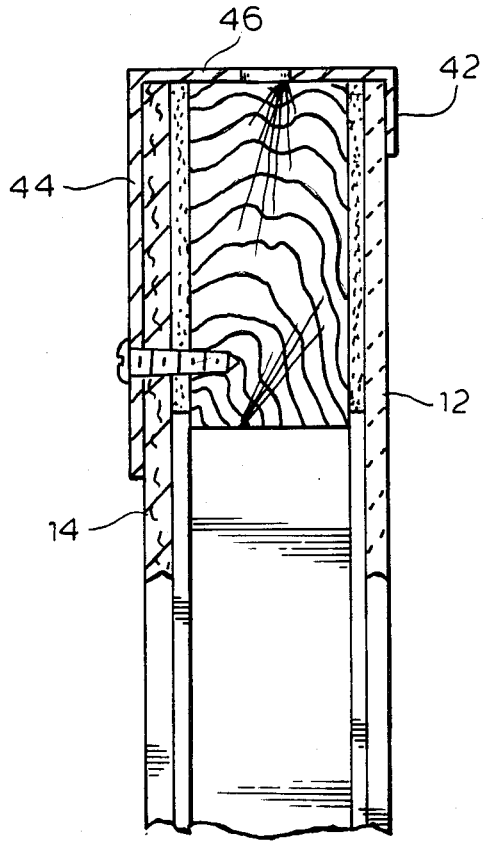
FIG. 6 shows mounting details for the mirror clip.

The longitudinal edges of mirror 12 are protected by the web extension 36. In order to insure that the mirror 12 does not separate from the assembly four or more brackets 40 may be used. As shown in FIGS. 3 and 6, each of the brackets 40 is generally U-shaped with a relatively short leg 42, a longer leg 44 parallel with the short leg 42 and a connecting portion 46. The short leg is provided to hold the mirror 12 against rails 20, 22, and is the only visible portion of bracket. The portion 46 may extend across the thickness of the assembly. The bracket is secured to the backside 14 and the respective rail 20, 22 by screws 48, which are affixed through appropriate holes made through leg 44.

The door panel disclosed herein has numerous advantages over the prior art. For example the panel door can be made in any size and is not limited to standard sizes. Its construction eliminates problems due to warping because no glues with different thermal coefficient of expansion are used. It is relatively hollow and therefore it is light. It does not require a frame. It provides special protection to the edge of the mirror, which is normally prone to chipping. The mirror surface itself is unobstructed (except for the short legs of the brackets) providing a full view. Special mechanical interlocks between the various components have been eliminated. The panel can be used for standard pivoting doors, as well as for sliding doors and bi-folding doors. The door panel is substantially maintenance-free.

Obviously numerous modifications may be made to the invention with out departing from its scope as defined in the appended claims.

What is claimed is:

1. A door panel assembly comprising:

a front side comprising a mirrored surface affixed to a first adhesive cushion means;

a rear side extending in parallel with said front side;

support means disposed between said front and rear sides; and two parallel channels extending along corresponding edges of said sides and each comprising a web, a first flange, a second flange, a third flange, and a lip substantially coplanar with the web and extending past said third flange, said first and second flanges being spaced at a distance substantially equal to the thickness of the rear side and cooperating to hold said rear side, and said second and third flanges being spaced at a distance substantially equal to the thickness of said support means, and cooperating to hold said support means; said lip having a length which does not exceed the thickness of the front side; and the first and a second adhesive cushion means adhesively affixed between said support means and said front and rear sides respectively, said first and second adhesive cushion means being substantially coplanar with, and of substantially equal thickness to the second and third flanges respectively.

2. The assembly of claim 1 wherein said adhesive cushion means comprise a sponge or fibrous tape with two adhesive surfaces.

3. The assembly of claim 1 wherein said web extends past said third flange by a distance equal to or larger than the thickness of said front side.

4. The assembly of claim 1 further comprising U-shaped brackets for supporting said front side on said support means.

5. The assembly of claim 1 wherein said support means comprise at least two rails disposed in parallel to each other, and perpendicularly to said channels.

* * * * *